US005303895A

United States Patent [19]

Hart

[11] Patent Number: 5,303,895

[45] Date of Patent: Apr. 19, 1994

[54] APPARATUSES AND METHODS FOR HANGING FRAMES

[76] Inventor: Hoyt E. Hart, 9740 Colonial Cir., NE., Albuquerque, N. Mex. 87111

[21] Appl. No.: 904,000

[22] Filed: Jun. 24, 1992

Related U.S. Application Data

[63] Continuation-in-part of Ser. No. 822,061, Jan. 14, 1992, Pat. No. 5,209,449.

[51] Int. Cl.[5] ..... A47F 7/14

[52] U.S. Cl. ..... 248/475.1; 248/542; 248/544

[58] Field of Search ..... 248/494, 544, 475.12, 248/466, 489, 495, 542, 547; 40/152.1; D10/62

[56] References Cited

U.S. PATENT DOCUMENTS

| | | | |
|---|---|---|---|
| D. 282,054 | 1/1986 | Hoffman | D10/62 |
| 1,340,711 | 5/1920 | Greenwald | 248/489 |
| 2,075,588 | 3/1937 | Meyers | 248/489 X |
| 2,643,840 | 6/1953 | Lanman | 248/494 |
| 2,879,018 | 3/1959 | Pence | 248/494 |
| 3,552,708 | 1/1971 | Hillstrom | 40/152.1 |
| 3,955,790 | 5/1976 | Ballin | 248/489 |
| 4,220,309 | 9/1980 | Eisen | 248/542 |
| 4,228,982 | 10/1980 | Sellera | 248/467 |
| 4,437,639 | 3/1984 | Stein | 248/489 X |
| 4,458,873 | 7/1984 | Sutherland | 40/152.1 X |
| 4,530,482 | 7/1985 | Berinson | 248/475.1 |
| 4,531,315 | 7/1985 | Sobel | 40/152.1 X |
| 4,582,288 | 4/1986 | Ruehl | 248/547 |
| 4,597,554 | 7/1986 | James | 248/542 |
| 4,606,526 | 8/1986 | Rabinowitz | 248/489 |
| 4,712,762 | 12/1987 | Wassell | 40/152.1 |
| 4,804,161 | 2/1989 | Wallo | 248/544 |
| 4,883,247 | 11/1989 | Crandall | 248/495 X |
| 5,080,317 | 1/1992 | Letizia | 248/466 X |
| 5,178,355 | 1/1993 | Herzig | 248/493 X |

FOREIGN PATENT DOCUMENTS

| | | | |
|---|---|---|---|
| 384616 | 12/1932 | United Kingdom | 248/494 |
| 1031208 | 6/1966 | United Kingdom . | |

OTHER PUBLICATIONS

Advertisement, WallBuddies TM, Picture Perfect, Sioux Falls, S.D., *Picture Framing Magazine*, p. 43, (Jun. 1991).

Advertisement, PicTabs TM, LorLor TM, LorLor Corporation, Morton Grove, Ill., *Picture Framing Magazine*, p. 79, (Sep. 1991).

Advertisement, H-Hanger, Lion, Birmingham, England, *Decor Services* (Annual), p. 498, (1991-1992).

Advertisement, Record Art Gallery Rods, S&W Framing Supplies, Inc. Garden City Park, N.Y., *Decor*, p. 180, (Nov. 1991).

Advertisement, Arakawa Hanging Systems International, Portland, Ore., *Picture Framining Magazine*, p. 8, (Nov. 1991).

Advertisement, Starlight Industries Inc., Brooklyn, N.Y. 11201, *Picture Framing Magazine*, p. 65, (Jul. 1991).

Advertisement, De Luxe "Floreat" Hangers, Ziabicki Import Company, Racine, Wis., *Picture Framing Magazine*, p. 100, (Sep. 1991).

*Primary Examiner*—J. Franklin Foss

*Attorney, Agent, or Firm*—Rod D. Baker; Deborah A. Peacock

[57] ABSTRACT

The invention concerns apparatuses and methods for hanging frames upon mounting surfaces. The principal apparatus of the invention, upon which a frame is hung, is securely attached to a mounting surface, such as a wall. The apparatus comprises a generally planar body with a protruding supporting rail, alignment notches, spirit level, bracket recess, and mounting holes, and is particularly well suited for use with metal frames with universal assembly channels. The supporting rail of the apparatus is designed to be inserted within universal assembly channels in metal frames, thus securely yet slidably and removably attaching the apparatus to the frame. The invention also includes an adapter bracket to allow the principal apparatus to be used with any kind of frame, and special corner brackets to allow the use of the principal apparatus with unusually heavy or wide frames.

25 Claims, 5 Drawing Sheets

APPARATUSES AND METHODS FOR HANGING FRAMES

CROSS-REFERENCE To RELATED APPLICATIONS

This application is a continuation-in-part application of U.S. patent application Ser. No. 07/822,061, entitled "Apparatuses and Methods for Hanging Frames" to Hart, filed on Jan. 14, 1992, now U.S. Pat. No. 5,209,449 the teachings of which are incorporated herein by reference.

BACKGROUND OF THE INVENTION

1. Field of the Invention (Technical Field)

The invention relates to apparatuses for hanging frames upon surfaces, and methods for their use.

2. Background Art

Despite some variety of efforts to overcome the problem, there remains a need for an improved means for hanging framed works, one that assures that the work will hang securely in a level position The present invention fills the need by providing a simple, inexpensive, and easy-to-use apparatus and method that permit the user quickly and securely to hang a frame upon a wall or other vertical surface. Practicing the present invention, the user can consistently hang a frame on the level, with the top and bottom edges of the frame in a pleasantly horizontal aspect.

British Patent No. 1,031,208 to Chan discloses a picture-hanging apparatus comprising a supporting member to be attached to a wall and a second separate member, to be attached to the back of a picture frame, for engagement with the supporting member. The invention disclosed in the '208 Patent requires that a particular customized element be attached to the frame to be hung.

U.S. Pat. No. 4,228,982 to Sellera discloses an apparatus similar to the apparatus of the above-mentioned British patent to Chan. The '982 patent discloses an apparatus composed of two separate elements one element to be attached to a wall, and the other specially adapted companionate element necessarily attached to the frame to be hung.

U.S. Pat. No. 4,530,482 to Berinson discloses an apparatus for hanging framed pictures consisting of a lengthy resinous strip to be attached to the wall and picture mounts with sharp edges to be attached to picture frames. The sharp edges of the picture mounts are then inserted between the strip and wall to hang picture frames. The apparatus necessarily includes a specially adapted element to be attached to the frame to be hung.

U.S. Pat. No. 4,597,554 to James also describes an apparatus consisting of a matched pair of fixture members, one of which must be attached to the picture frame.

U.S. Pat. No. 4,606,526 to Rabinowitz discloses a picture frame hanging apparatus consisting of a single block having hanger projections extending laterally along at least two sides thereof for engagement with the frame to be hung.

U.S. Pat. No. 4,804,161 to Wallo describes an apparatus consisting of a base bar of substantial width having upwardly projecting prongs at opposite ends thereof which are adapted to engage a downwardly facing surface of the top moulding of a frame. The apparatus includes a horizontally elongate fastener hole and a vertically elongate fastener hole for consecutive adjustment of the horizontal and vertical position of the apparatus. The apparatus does not provide a locking mechanism for accidental dislocation.

U.S. Pat. No. 3,955,790 to Ballin discloses a three-part apparatus consisting of a pronged base plate to be mounted to a wall, a plumb member, and a coupling member to be mounted upon a frame. The plumb member swingably rests upon a fulcrum element of the base plate to indicate when the base plate is level. The base plate may be successfully used only in conjunction with the frame-mounted coupling member, which is shaped to interlock with the base plate.

U.S. Pat. No. 4,582,288 to Ruehl describes a device for securing cables or wires to a support surface, and discloses a means for pre-driving the securing pins in a manner to allow mounting to fragile surfaces.

U.S. Pat. No. 4,712,761 to Wassell discloses a picture frame corner bracket consisting primarily of a downwardly extending corner flange for engagement with a trough extending the length of an elongated wall-mounted strip.

U.S. Pat. No. 4,437,639 to stein describes a self-adjusting picture hanger apparatus consisting of a wall-mounted member linked to a frame mounted member. The members rotatably coact with one another so that gravity causes the frame to seek a vertical position. Notches are provided to assist in vertically mounting the wall-mounted member. No means for slidably adjusting the horizontal position of the frame is disclosed.

U.S. Pat. No. 4,458,873 to Sutherland discloses a one-piece clip apparatus for use with frames having an inwardly facing channel along the upper periphery thereof.

U.S. Pat. No. 4,531,315 to Sobel describes a corner bracket for use in assembling frames incorporating universal assembly channels.

U.S. Pat. No. 5,080,317 to Letizia discloses a picture anchoring assembly utilizing a spirit level to assure the level mounting of a picture frame.

U.S. Pat. No. 3,552,708 to Hillstrom describes a picture hanging apparatus including a picture frame element having a hollow recess and a frame-mounted clip insertable into the frame recess mounting for mounting on a nail.

U.S. Pat. No. 4,220,309 to Eisen, et al. discloses a method and apparatus for positioning frame-hanging devices upon a wall to assure proper placement of the picture.

U.S. Design Pat. No. 282,054 to Hoffman discloses an ornamental design for a picture hanging aide.

Also known are opposing pairs of roughly triangular devices removably slidable within the side frame channels of a frame. Each of the devices has a hole on one wing thereof permitting connection of a wire between the pair of devices. The wire can then be placed over a nail on a wall or other vertical surface, thereby supporting the frame.

Nevertheless, the frustration of attempting to hang framed artwork with the traditional "hook and wire" method continues to be a nearly universal experience. Even utilizing more than one hook, it is difficult to maintain a frame straight and level using the traditional method. Frames suspended by the standard hook and wire method tend to fall away from the wall at the top, resulting in unattractive gaps between the wall and the top of the frame. Moreover, it is practically impossible to align a series of frames (either vertically or horizontally) using the hook and wire system due to the variations in wire placement, and lengths and flexibility of differing wire types. This configuration also results in the picture's load-vector being directed down the wall providing no wall support for the hanger device. Proper frame hangers should be designed to direct load-vectors into the wall to provide optimum support for the valuable framed art installed on them.

Parent application Ser. No. 07/822,061, entitled "Apparatuses and Methods for Hanging Frames" to Hart, filed Jan. 14, 1992, relates to an apparatus and method for hanging frames on a mounting surface. The apparatus of the invention comprises a mostly planar body with a protruding supporting rail, a bracket recess, mounting holes and two distinct means for assuring the horizontal, level, mounting of the body upon the mounting surface. The means for assuring a level mounting include the use of a removable spirit level or, alternatively, alignment notches to align the body relative to a horizontal line on the mounting surface. The apparatus is particularly well suited for use with metal frames having universal assembly channels, as the supporting rail of the body is designed to be inserted within universal assembly channels to securely yet slidably and removably attach the apparatus to a frame. Use of a common Z-bracket to adapt the invention to ordinary wooden frames is also disclosed. The teachings of the parent application Ser. No. 07/522,061 are hereby incorporated by reference.

SUMMARY OF THE INVENTION (DISCLOSURE OF THE INVENTION)

The present invention is of apparatuses for hanging a frame on a surface as well as of methods for hanging frames.

The primary apparatus of the invention comprises a body having a front, a back, and a top; a slidable attachment of the body to the top of the frame; and an attachment of the body to the target surface. In the preferred embodiment, the apparatus further comprises a spirit level removably attached to the body for aligning the body on the surface and the body comprises protruding clip retainers for holding the spirit level. Alternatively, alignment may be performed by at least two alignment notches (preferably V-shaped) disposed on sides of the body, the notches being alignable to a straight line marked on the surface. The removably slidable attachment is preferably a supporting rail disposed on the front of the body which throughout its length protrudes perpendicularly from the front and which has a cross section corresponding to a channel in the frame thereby permitting slidable insertion of the supporting rail in the frame channel. The invention includes, however, a designed adapter bracket and method for practicing the invention on standard wooden or other material frames. Alternatively, the removably slidable attachment may comprise a recession disposed on the back of the body and a Z-bracket removably and slidably attachable to the frame having a leg corresponding to the recession.

The attachment of the body to the target surface preferably comprises at least two openings completely penetrating the body from front to back capable of holding fasteners. Preferably, at least one of the openings is near the center of the body and at least one penetrates the body at an oblique angle. The openings should have a diameter corresponding to the diameter of the fasteners.

The second apparatus of the invention comprises a body having a front, a back, and a top; an attachment of the body to the frame; at least two alignment notches in the body; and an attachment of the body to the target surface. Preferably, the alignment notches are V-shaped, disposed on sides of the body, and alignable to a straight line marked on the surface.

The first method of the invention comprises the steps of: (a) providing a hanger; (b) placing the hanger flush against a mounting surface; (c) inserting at least one fastener at least partially into the hanger; (d) positioning the hanger at a desired location upon the mounting surface; (e) inserting the first fastener completely through the hanger and into the mounting surface; (f) referring to a spirit level disposed on the hanger; (g) rotating the hanger about the first fastener until the hanger is horizontal according to the spirit level; and (h) inserting at least one additional fastener through the hanger and into the mounting surface to position and attach the hanger on the surface. The hanger preferably comprises a protruding elongated supporting rail with a shape corresponding to a universal assembly channel of the frame for removable and slidable attachment of the supporting rail within the universal assembly channel. Alternatively, the hanger comprises an elongated recess and an adapter bracket for removable and slidable disposition on the elongated recess.

The second method of the invention comprises the steps of: (a) providing a hanger having alignment notches; (b) marking a mounting surface with a straight guide line; (c) placing the hanger flush against the mounting surface; (d) aligning the alignment notches with the straight guide line; and (e) attaching the hanger to the mounting surface. In the preferred embodiment, the hanger is provided with V-shaped alignment notches on the sides of the hanger.

The third method of the invention comprises the steps of providing a hanger and slidably attaching the top of the frame to the hanger.

Additionally, special corner brackets and methods for their use are disclosed for utilizing a pair of hangers in heavy-duty application to mount large or heavy frames. An apparatus and method for securing the bottom of a frame to a mounting surface to assure a flush and fixed position is also described.

An object of the present invention is to provide a simple, inexpensive means and method for consistently hanging frames straight and level.

Another object of the present invention is to provide an apparatus for hanging frames that is easy to use.

Another object of the present invention is to provide an apparatus for hanging frames that is inexpensively manufactured.

Another object of the present invention is to provide a means and method for consistently hanging frames straight and level that requires no attachments upon the frame.

Another object of the present invention is to provide a means and method for hanging frames that secures the frame flush against the wall or other surface.

It is another object of the present invention to provide a means and method for hanging multiple frames in horizontal alignment.

Still another object of the present invention is to provide a means and method for hanging multiple frames in vertical alignment.

Another object of the present invention is to provide a means and method for hanging frames of various weights and types.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practicing the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principle of the invention. The drawings are only for the purpose of illustrating a preferred embodiment of the invention and are not to be construed as limiting the invention.

DESCRIPTION OF THE PREFERRED EMBODIMENT (BEST MODE FOR CARRYING OUT THE INVENTION)

The primary embodiment of the present invention is a simple, one-piece frame positioning bracket for hanging artwork, picture frames or like objects upon a wall or other mounting surface. The apparatus is particularly suited for use with metal picture frames having universal assembly channels, although by utilizing adapter devices the apparatus may satisfactorily be practiced with a wide variety of frame types. The design and configuration of the apparatus permit the user consistently to mount frames upon walls in a straight and level manner and flush against the wall. A horizontal rail feature of the apparatus, which accepts a metal frame's universal assembly channel, permits lateral, side-to-side adjustment of a frame once it has been hung. Other elements of the apparatus of the invention permit the user easily to utilize a plurality of the apparatus to hang numbers of frames in horizontal and/or vertical alignment, while assuring that each frame retains its level position upon the wall. The apparatus may be any practicable size; thus, the apparatus may be produced in a variety of sizes.

Reference is made to FIGS. 1–7 which illustrate the preferred apparatus of the invention. The apparatus includes a body 10, made of injection-molded plastic or any other inexpensive, durable material. The material of body 10 preferably is somewhat elastic, such that body 10 generally is quite stiff, but with some resilient flexibility in response to focused loading. Body 10 is substantially planar, with the exception of certain protruding features later described herein.

Figure 1:
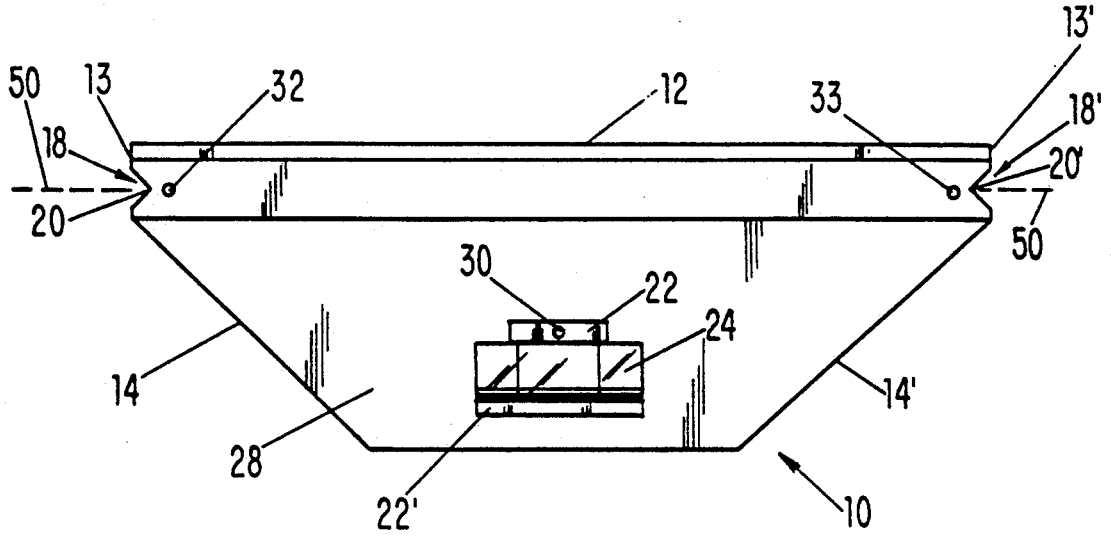
FIG. 1 is a plan view of the front of the preferred embodiment of the apparatus of the invention.
Figure 2:
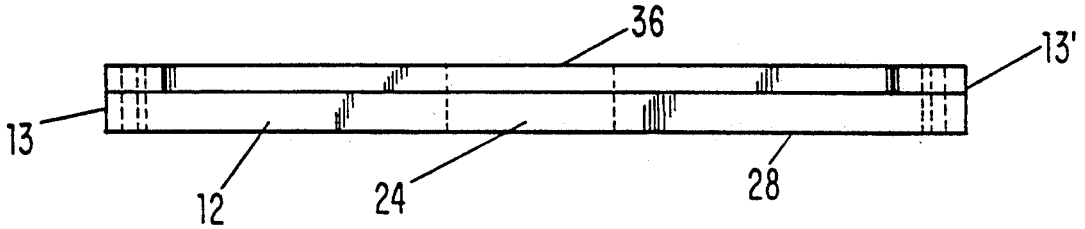
FIG. 2 is a plan view of the top of the FIG. 1 embodiment.
Figure 5:
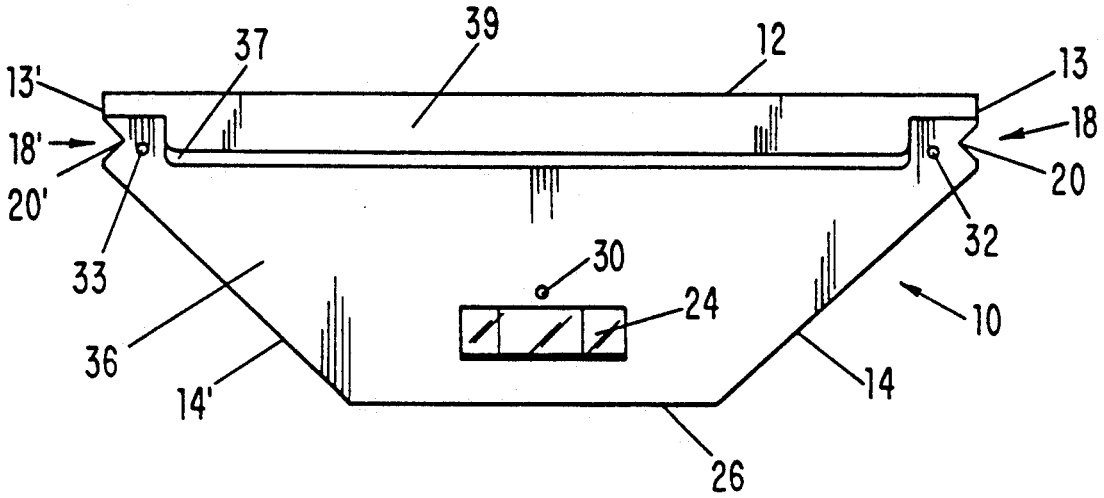
FIG. 5 is a plan view of the back of the FIG. 1 embodiment.

Body 10 preferably is generally trapezoidal in shape when viewed from the front, the longer of the parallel sides of the trapezoid being the top 12 of the apparatus. Other shapes (e.g. rectangular, square, triangular, etc.) may also be used. The trapezoidal section of body 10 is truncated at each location where the non-parallel sides 14,14' otherwise would intersect with top 12, in order to create short vertical sides 13,13' at right angles with top 12. Alignment notches 18,18' are linear-sided recesses formed into vertical sides 13,13' of body 10. As best illustrated in FIGS. 1 and 5, alignment notches 18,18' are formed in the shape of triangles, with one side of each triangle collinear with one of vertical sides 13,13, Equilateral triangles are preferred, although isosceles triangles will also suffice (provided the odd sides of isosceles triangles are collinear with corresponding vertical sides 13,13'). Interior vertices 20,20' of alignment notches 18,18' are situated at points equidistant from top 12, so that the line defined by interior vertices 20,20' is parallel to top 12. Importantly, alignment notches 18,18' are situated such that the line defined by their interior vertices 20,20' bisects the interior angles of both alignment notches 18,18'.

Clip retainers 22,22' grasp spirit level 24. Clip retainers 22,22' protrude from the front 28 of body 10. Throughout this specification, it shall be understood that the front 28 of the apparatus shall be adjacent to and in contact with the item of art to be hung, while back 36 is the face of the apparatus that shall be in direct contact with the wall. Clip retainers 22,22' preferably are an integral part of body 10, that is, they are formed of the same material as body 10 and are an extension thereof. Clip retainers 22,22' may be located nearly anywhere on front 28 of body 10; in the preferred embodiment they are located near and parallel to the bottom 26 of body 10, equidistant from non-parallel sides 14,14'. Importantly, clip retainers 22,22' are parallel to each other and with the top 12 of the apparatus. Clip retainers 22,22' are elongated, and are so formed as to exploit the elastic nature of the composition material; their flexibility permits spirit level 24 to be removably inserted between them such that spirit level 24 is securely grasped by clip retainers 22,22' while the apparatus is in use. Likewise, spirit level 24 may be removed from the grasp of clip retainers 22,22' when the apparatus is not in use, with the result that the resiliency of clip retainers 22,22' causes them to spring back to their original configuration.

Figure 6:
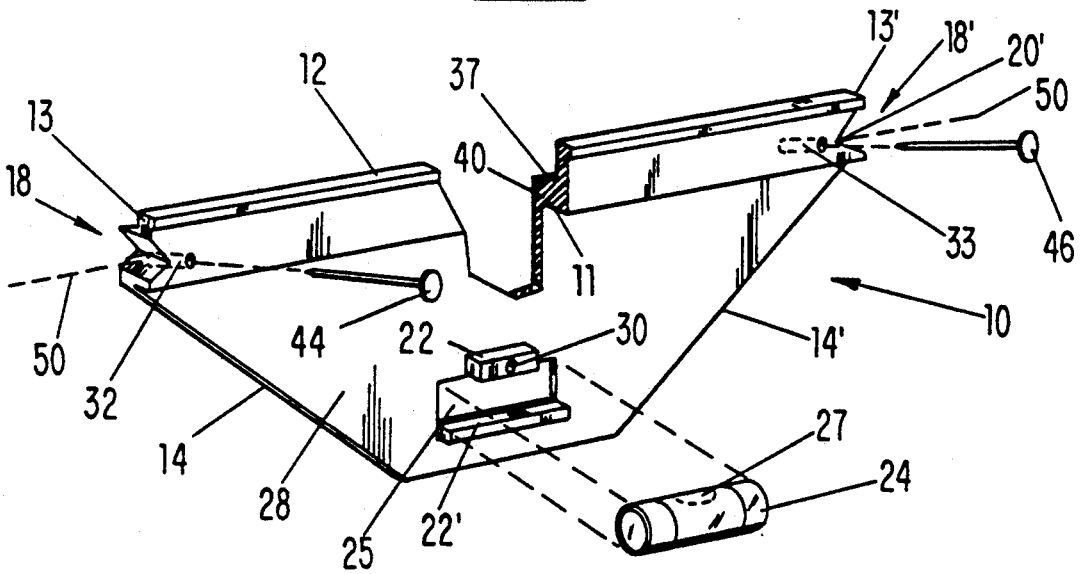
FIG. 6 is a perspective view of the front of the FIG. 1 embodiment with a portion of the apparatus broken away to illustrate a partial cross section of the apparatus.

If necessary to accommodate the reception of spirit level 24 between clip retainers 22,22', body 10, as shown in FIG. 6, may include spirit level opening 25. Spirit level opening 25 is a rectangular opening through body 10, between clip retainers 22,22', that allows spirit level 24 to be inserted between clip retainers 22,22' and remain in position while the apparatus is in use. Clip retainers 22,22' extend outwardly at a sufficient distance to be even with or beyond spirit level 24, to prevent spirit level 24 from being damaged. Spirit level opening 25 alternatively may be a depression (e.g. concave) rather than an opening.

Figure 3:
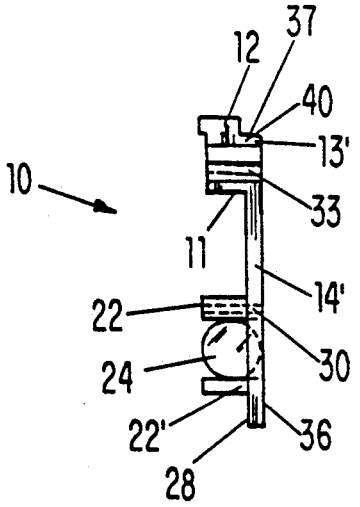
FIG. 3 is a plan view of the side of the FIG. 1 embodiment.
Figure 4:
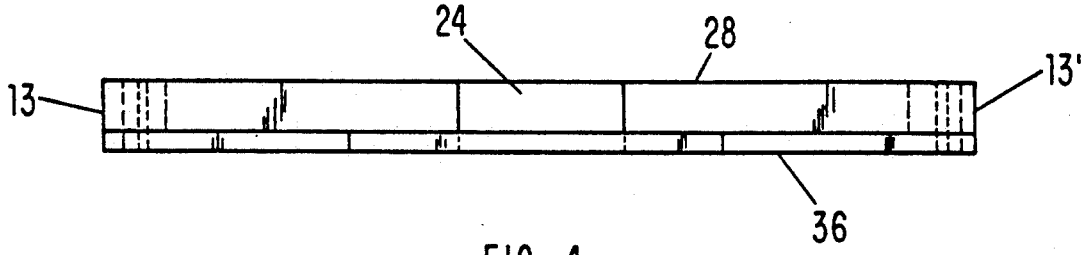
FIG. 4 is a plan view of the bottom of the FIG. 1 embodiment.

As best illustrated in FIG. 3, a portion of body 10 is of additional thickness to form reinforcing rib 11, which runs parallel and adjacent to top 12. Reinforcing rib 11 is observed to be an integral part of body 10 in the shape of a long box extending between vertical sides 13,13'.

Referring to FIGS. 1 and 3, it is seen that extending upwardly and outwardly from reinforcing rib 11 is supporting rail 40, which, like reinforcing rib 11, preferably is an integral part of body 10 and composed of the same material. Supporting rail 40 runs between vertical sides 13,13', adjacent to and along the entire length of top 12. As more particularly illustrated in FIG. 3, supporting rail 40 has a stepped profile, as it extends outward from front 28 a distance approximating the depth of a corresponding frame, and also upward a small distance from top 12. As best shown in FIG. 6, supporting rail 40 and reinforcing rib 11 together present a particular universal cross section throughout their common length. This unique cross section is so designed as to permit the apparatus of the invention specially to interlock with the frame to be hung.

As shown in FIGS. 1 and 6, the uppermost of the two clip retainers 22,22', which preferably is an integral portion of body 10, has additional thickness for purposes of strengthening the apparatus and accommodating a specialized mounting hole 30 as shall hereinafter be described. It is observed, therefore, that excepting clip retainers 22,22' and supporting rail 40, which protrude from the face of front 28, front 28 preferably is smooth and flat.

Brief reference is made to FIGS. 3, 5–7, 14, and 18, showing back 36 of body 10. Back 36 is substantially smooth and flat, which characteristic permits the apparatus to be mounted flush against a wall or other flat mounting media. The semi-flexible character of body 10 also permits the satisfactory mounting of the apparatus to walls or other media having a slight curvature or minute surface irregularities. Back 36 has rear ledge 37, which is a horizontal surface parallel to the plane of top 12 resulting from the abrupt narrowing in the thickness of body 10 along top 12. This narrowed thickness in body 10 is manifested in the form of a bracket recess 39 also running the width of top 12 at a depth equivalent to the depth of rear ledge 37. Rear ledge 37 runs the entirety, or nearly the entirety, of the width of top 12; it may be modified as needed to accommodate the location of side mounting holes 32 and 33, as illustrated in FIG. 5.

Body 10 further comprises central mounting hole 30, and side mounting holes 32 and 33. Central mounting hole 30 and side mounting holes 32 and 33 are small-diameter holes drilled or otherwise formed as to completely penetrate through body 10 from front 28 to back 36. Central mounting hole 30 is situated equidistant from non-parallel sides 14,14' at the center of the uppermost of the two clip retainers 22,22'. The uppermost clip retainer 22, preferably is of greater mass than lower clip retainer 22', so as to be reinforced to accommodate central mounting hole 30. Side mounting holes 32 and 33 each penetrate reinforcing rib 11 near the ends of top 12, a short distance from the respective interior vertices of alignment notches 18,18'.

Specific reference is made to FIG. 3. It is noted that side mounting holes 32 and 33 penetrate body 10 at oblique angles downward from front 28 to back 36, such that the openings of the holes on front 28 are somewhat closer to top 12 than the corresponding openings on back 36. Central mounting hole 30 penetrates body 10 at an angle normal to front 28 and back 36. The diameters of central mounting hole 30 and side mounting holes 32 and 33 are preferably approximately equal to, or slightly less than, the diameter of the fasteners with which the apparatus will be hung and the holes are preferably tapered to hold the nail firmly during mounting. Preferably, the diameters of the mounting holes 30,32,33 are just slightly less than the diameters of the fasteners to be used, so that a slight amo*pn of force may be required to insert the fasteners into the mounting holes 30,32,33. These features of the apparatus allow the three mounting holes 30,32,33 to serve as "nail keepers" which grasp and hold the nails or screws while the user hammers or turns the fasteners into the wall. In the preferred embodiment, the fasteners to be used are nails. Alternatively, screws may be used to hang the apparatus. An advantage of the invention is, therefore, that it is easily practiced by a single user; the apparatus' three mounting holes 30,32,33 hold the fasteners, thus freeing one of the user's hands to operate a hammer or screwdriver while the other hand holds the apparatus 10 in place.

Figure 7:
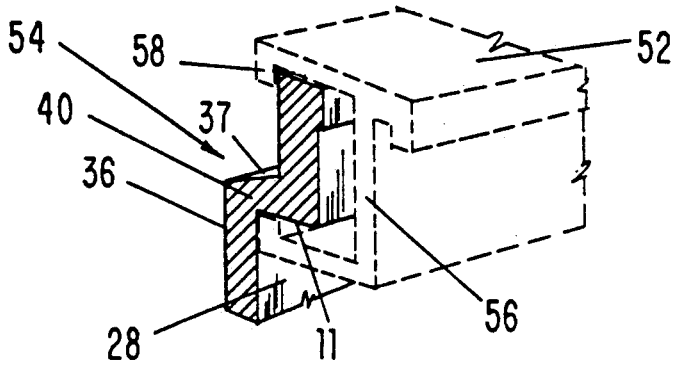
FIG. 7 is a perspective view of the FIG. 1 embodiment shown mounted in a typical metal frame channel.

The preferred method of practicing the invention is best understood with reference to FIGS. 6 and 7. Spirit level 24 is snapped into position between clip retainers 22,22' on the front 28 of the apparatus 10 and into spirit level opening 25 as needed. The apparatus 10 is then placed against the wall or other mounting medium, and held by hand at the desired mounting location. Top 12 of the apparatus is positioned approximately horizontal on the wall and slightly below the desired location of the top of the frame to be hung. The user then manually inserts nails 44,46 (only two shown) or other suitable fasteners into central mounting hole 30 and side mounting holes 32 and 33. The "nail keeper" advantage of the invention comes into play as the snug fit between the fasteners and the mounting holes 30,32,33 causes the fasteners to remain within the mounting holes 30,32,33, in ready position to be hammered or screwed, while the user's hands are freed to position the apparatus 10 and wield tools.

Using spirit level 24, the user adjusts and manipulates the apparatus 10 until it is in a level position on the wall as shown by the level 24. It is easily observed that when the bubble 27 in spirit level 24 gives visual indication that spirit level 24 is level, the entire apparatus 10 likewise will be level, with both top 12 and supporting rail 40 in horizontal position (and presumably parallel to the floor and ceiling).

Holding the apparatus 10 thus positioned with one hand, with the other hand the user hammers the nail (not shown) disposed within central mounting hole 30 through central mounting hole 30 and into the wall. The nail is not hammered completely into the wall; a small length of nail is left exposed between the apparatus and the head of the nail so that the apparatus remains free to rotate about the nail. This continued freedom of rotation about the central fastener allows the user to perform any further required positional adjustments to restore and maintain the apparatus' horizontal disposition.

Having constant reference to spirit level 24, the user maintains the apparatus in a level position while a side nail 44 (or alternatively 46), held by either of the two side mounting holes 32 (or alternatively 33), is hammered through the side hole 32 and into the wall. This side nail 44 through side mounting hole 32 is gently hammered until the head of the side nail 44 is snug against the front 28 of the apparatus and the apparatus is securely held thereby. During the hammering of this first side nail 44, the user exercises care to maintain the horizontal position of the apparatus; in the event the apparatus is mispositioned, the first side nail 44 is withdrawn, the apparatus is readjusted, and hammering is recommenced.

Once the first side nail 44 or 46 is hammered into position, the unhammered second side nail 46 (or alternatively 44) in the other side mounting hole 33 (or alternatively 32) is also hammered home. The user will no longer need manually to hold the apparatus in place, as it is secured by the nail through the central mounting hole and by the first side nail 44. Because the latter two fasteners are already secured within the wall, the level position of the apparatus is fixed, and not easily disturbed during the hammering of the second side nail 46. Finally, the nail through central mounting hole 30 is gently hammered until its head is snug against the front 28 of the apparatus. It thus is noted that the triangular arrangement of the mounting holes and fasteners, and the sequential securing of the fasteners as described, permits the user easily to attach the apparatus to the wall in a level position through constant reference to spirit level 24.

While the preferred embodiment of the apparatus contemplates the use of three fasteners, it will be apparent to one skilled in the art and having reference to the above disclosure that any number of fasteners greater than one will suffice. Specifically, it is noted that two fasteners, with corresponding mounting holes, would permit the invention adequately to be practiced; additional numbers of fasteners provide added security.

If desired, spirit level 24 may then be removed from the apparatus and reused in another apparatus of the invention. Alternatively, spirit level may remain in the apparatus, where it will be covered by the artwork and thus be invisible to observers.

Thus secured to the wall, the apparatus is ready to accept a frame for hanging. Further explanation of the hanging method shall follow hereinafter.

An alternative method of practicing the invention is particularly well suited to hanging multiple frames in a horizontal line of display. Using a tape measure or spirit level and a carpenter's chalk line, or other conventional means, the user of the invention causes a thin (approximately 1 mm) horizontal line (shown in FIG. 1 as a dashed line 50) to be temporarily marked upon the wall or other mounting medium. Such a line 50 should be sufficiently long to accommodate the desired number of frames at the desired horizontal spacing. The height of the line 50 above the floor should be approximately the desired distance from the floor to the tops of the frames.

Reference is made to FIGS. 1 and 6. With the temporary horizontal line 50 on the wall serving as a guide, alignment notches 18,18' are used in lieu of a spirit level to assure the horizontal positioning of the apparatus. The user first inserts the desired fasteners into central mounting hole 30 and side mounting holes 32 and 33, as in the preferred methodology described above. The user then places the apparatus 10 against the wall so that both interior vertices 20,20' of alignment notches 18,18' are located precisely upon the horizontal wall line 50, i.e., such that the horizontal wall line 50 bisects exactly the interior angles of alignment notches 18,18'. The fasteners, preferably nails, are then hammered into the wall in the same order and manner as described in the preferred methodology, except that the user has constant reference to the horizontal wall line 50, instead of a spirit level, in order to maintain the level position of the apparatus 10 during hanging. Assuming that the horizontal wall line 10 is truly level, placing the interior vertices 20,20' of alignment notches 18,18' upon that line 50 will assure the horizontal position of the apparatus 10 and its supporting rail 40. Visible portions of the horizontal wall line 50 may be erased after the artwork(s) are hung in final position.

It here is noted that the methodology described immediately above may have application to objects, other than frames, to be attached to a surface. The method may be practiced with nearly any device upon which another item will be attached. Likewise, the surface need not be a wall, but can be any surface to which a frame or other device needs to be attached.

In all embodiments and methodologies, the order of certain of the method steps may be varied without adversely affecting the practice of the invention. The fasteners may be inserted in the mounting holes either before or after the apparatus is placed against the wall; the fasteners may be inserted either before or after the apparatus is leveled; the order in which the fastening nails are hammered home may be varied; and the like. The method claims are thus not limited to the order of steps set forth therein.

Figure 8:
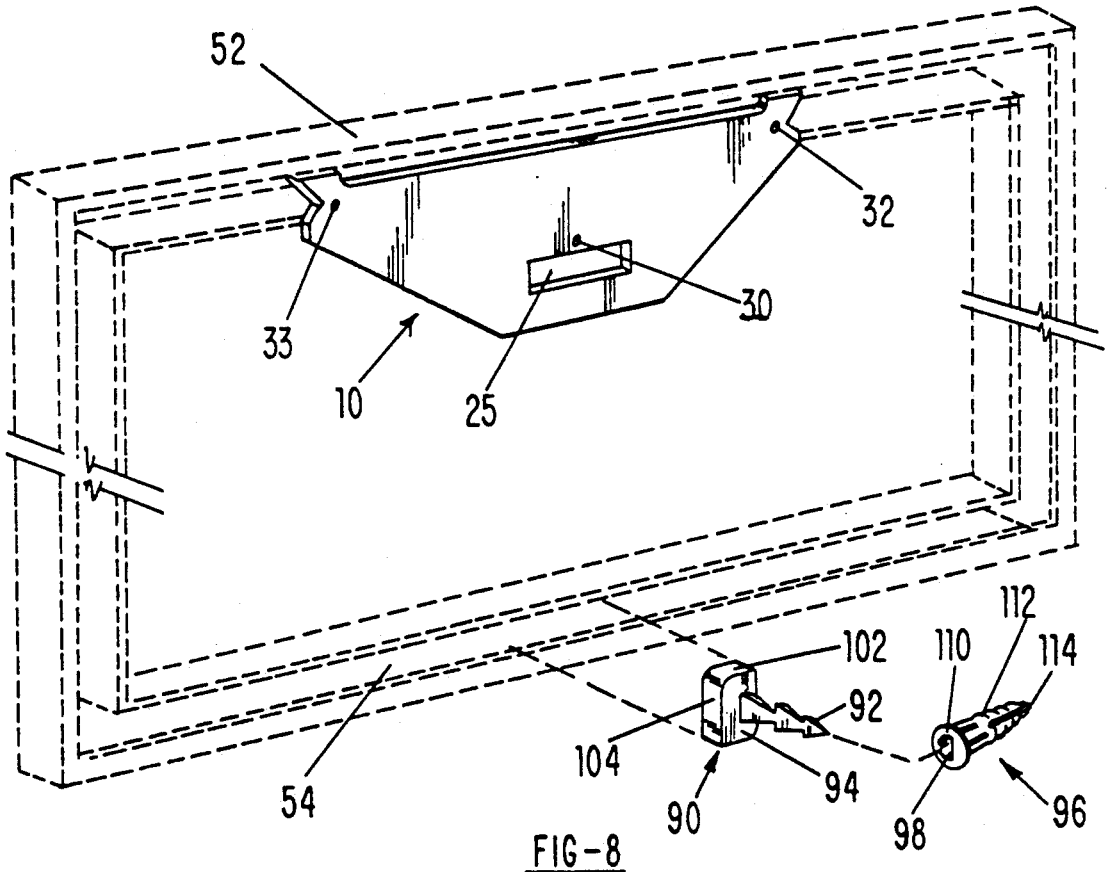
FIG. 8 is a perspective view of the FIG. 1 embodiment mounted upon a frame and bottom retaining pin and socket of the invention.
Figure 9:
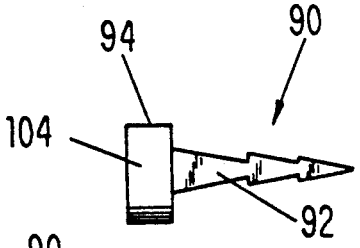
FIG. 9 is a side view of the bottom retaining pin and socket embodiment of FIG. 8.
Figure 11:
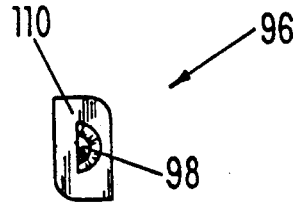
FIG. 11 is a top plan view of the bottom retaining pin embodiment of FIG. 8.
Figure 10:
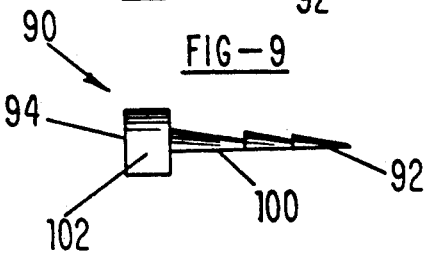
FIG. 10 is a front view of the bottom retaining pin embodiment of FIG. 8.
Figure 12:
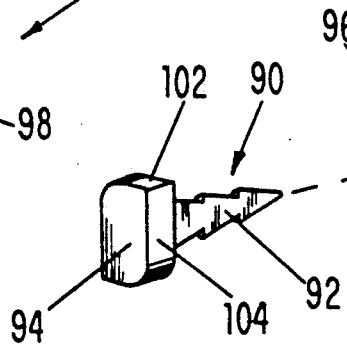
FIG. 12 is a perspective view of the bottom retaining pin embodiment of FIG. 8.
Figure 13:
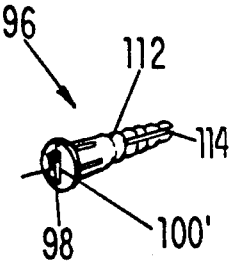
FIG. 13 is a perspective view of the socket embodiment of FIG. 8.

Reference is now made to FIGS. 7 and 8. Metal artwork frames 52 commonly used in the art are typically fashioned from lengths of molded or extruded aluminum or other inexpensive material. These sections of material normally are molded or extruded to include, as an integral part of the frame, universal assembly channels 54—recesses within the four sections of the frame, used to accommodate the right-angle brackets used to attach the sections together. The universal assembly channel 54 has a universal angular C-shaped cross section 56, runs the entire length along the interior of the frame's sides, top and bottom, and permits the installation of right-angle brackets within the channels at the frame's interior corners. The open portion of the C-shaped cross section 56 opens outwardly to the rear of the frame (e.g. toward the wall). Accordingly, the universal assembly channel 54 is hidden against the wall when the picture is hung. The uppermost section of the universal assembly channel 54, as it runs along the inside of the top section of the frame, serves as a lip or rib 58 which may be received onto a customized mount attached to a wall. It is an object of the present invention to provide just such a customized mount.

Once the apparatus of body 10 is securely attached to the wall or other mounting medium, a picture frame is easily hung thereon using supporting rail 40. As may be noted from the drawings, when the apparatus properly has been installed on the wall, supporting rail 40 extends outward and upward, i.e. away from the wall. It thus effectively serves as a continuous mount running the width of the apparatus, upon which the picture frame may be hung. The simplicity of the invention is exploited by lifting the framed art to the apparatus, and manipulating the frame until the entire length of supporting rail 40 is inserted into the universal assembly channel 54 within the top section of the frame. While hanging the frame upon the apparatus, it is necessary to hold the frame at an angle (e.g., 45°), the top section closer to the wall, in order to facilitate the entry of supporting rail 40 into the universal assembly channel 54. Once supporting rail 40 has been disposed in the universal assembly channel 54, the frame is then gently rested against the wall and left to hang upon the apparatus body 10, where it is locked onto the rail and cannot be accidentally dislodged.

The uppermost portion of the universal assembly channel 54 (having, as it does, a C-shaped cross-section 56) provides not only a horizontal surface which rests upon the top of supporting rail 40 and thus supports the frame, but also a vertical, downwardly projecting surface that is situated between supporting rail 40 and the wall. Supporting rail 40 and the universal assembly channel thus interlock. When properly engaged, therefore, the length of supporting rail 40 fills some or nearly all the void of the universal assembly channel 54, and prevents the frame from being pulled away from the wall without first being lifted up and over supporting rail 40. As can be seen, no hanging wires, hooks, or other devices are required to be attached to the frame; the attached apparatus 10 of the invention, by fitting into the universal assembly channel 54 provides both wall attachments and frame attachments. The horizontal position of the frame may easily be adjusted merely by sliding the frame back and forth upon supporting rail 40, which is free to slide within the universal assembly channel.

Used alone, body 10 causes a frame to hang flush against the wall, yet permits the bottom of the frame to be swung outward from the wall and the frame to be moved from side to side. It may be desired to supplement the apparatus of body 10 with a means for securing the frame against the wall via the bottom of the frame. The invention includes the optional use of bottom retaining pin 90 in conjunction with socket 96, as shown in FIGS. 8–13. Bottom retaining pin 90 is locked into the universal assembly channel 54 of the frame, and then inserted in socket 96 which has been mounted in the wall.

Bottom retaining pin 90 includes shank 92 and pin head 94. Shank 92 is shaped so as to be readily insertable into, but not easily withdrawn from, the void 98 of socket 96. Alternatively, pin 90 can be inserted directly into the wall. Pin head 94 is of a rectangular box shape and is shaped for placement within the interior of the C-shaped cross section 56 of the universal assembly channel 54 forming the bottom of the frame. Narrow side 102 of pin head 94 has a sufficiently short dimension to allow pin head 94 to be inserted into C-shaped cross section 56. Wide side 104 has a sufficiently long dimension as to cause pin head 94 to be interlocked within universal assembly channel 54 after having been rotated ninety degrees about the axis of shank 92.

Socket 96 is preferably fashioned of flexible plastic. It is very generally in the shape of a hollow frustum and is preferably shaped similarly to bottom retaining pin 90 to directionally receive bottom retaining pin 90. Opening at base 110 is interior void 98. Wall 112 of socket 96 may be cut with one or more slits 114 to give the entire socket 96 an added measure of expandibility when shank 92 is inserted therein. Void 98 and shank 92 preferably have corresponding flat surfaces 100,100', shown in FIGS. 10 and 13, to key the insertion of bottom retaining pin 90 into socket 96.

The foregoing supplemental mounting system is quickly and easily used. After the frame has been hung (upon a mounted body 10 of the invention or otherwise), the bottom of the frame is lifted away from the wall. A bottom retaining pin 90 is manipulated so as to place wide side 104 of pin head 94 parallel to the longitude of the (horizontal) bottom universal assembly channel 54 of the frame, thus permitting pin head 94 to be inserted into the interior of the C-shaped cross section 56 thereof, owing to the short dimension of narrow side 102. Bottom retaining pin 90 is then rotated ninety degrees about the axis of shank 92, placing wide side 104 in a vertical attitude within the universal assembly channel 54 and interlocking the bottom retaining pin 90 in place therein.

Following the placement of the bottom retaining pin 90 within tee bottom universal assembly channel 54, the frame is gently lowered until the tip of bottom retaining pin 90 contacts the wall. The point of contact is marked, the frame is again lifted away from the wall, and a hole is drilled or otherwise made at the mark, corresponding in diameter to the approximate average diameter of socket 96. Socket 96 is then securely inserted (narrow end first) into the wall, and the frame is lowered against the wall. Shank 92 of bottom retaining pin 90 is snugly inserted into void 98 of socket 96, thus firmly attaching the bottom of the frame to the wall. The keyed flat surfaces 100,100' of socket 96 and bottom retaining pin 90, respectively, are interpositioned to assure that pin head 94 is maintained at the proper position within universal assembly channel 54.

The invention may satisfactorily be practiced with frames lacking universal assembly channels. Attention is directed to FIGS. 14–21, illustrating adapter bracket 70. Adapter bracket 70 may be formed of any inexpensive, stiff material; preferably it is made of the same material as body 10 e.g. injection-molded plastic. Attached to an alternative frame 48 not having universal assembly channels, adapter bracket 70 allows the principal apparatus of the invention, body 10, to be used in conjunction with virtually any frame type, particularly wooden or plastic frames.

Adapter bracket 70 is rectilinear with a reinforcing ridge 72 running the length of top 74. Interior face 76 and exterior face 78 preferably are both smooth and flat, such that reinforcing ridge 72 forms a lip or rib protruding from interior face 76, and the opposing sides exterior face 78 and interior face 76 together constitute adapter bracket flange 84. At least two adapter fastener holes 80,80' extend through reinforcing ridge 72 near its ends and perpendicular to exterior face 78. Adapter fastener holes 80,80' are beveled at their openings.

Figure 14:
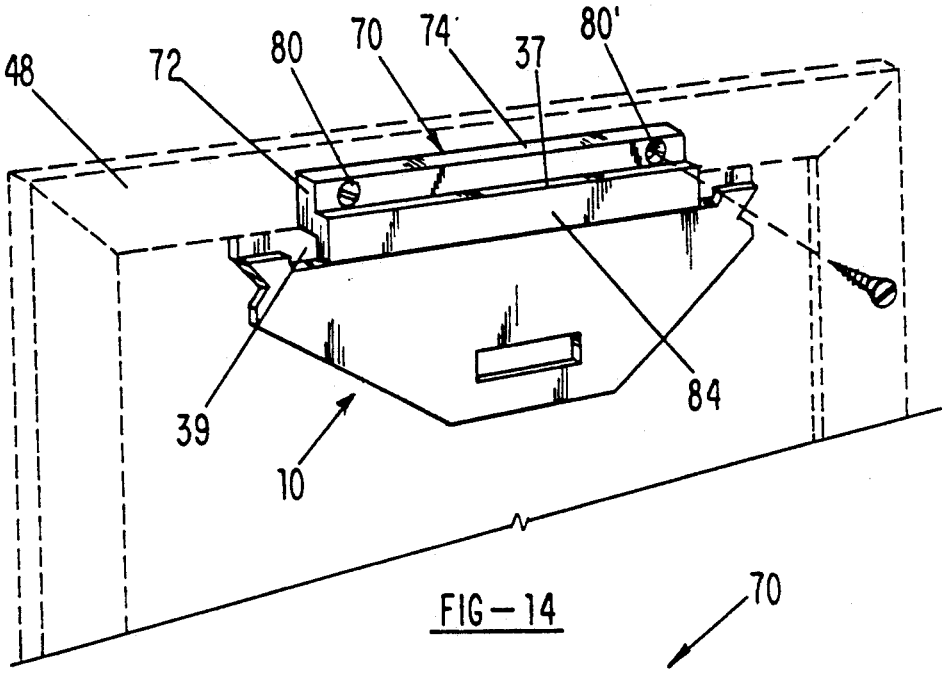
FIG. 14 is a perspective view of an alternative companion adapter embodiment mounted upon a frame in conjunction with the FIG. 1 embodiment.
Figure 15:
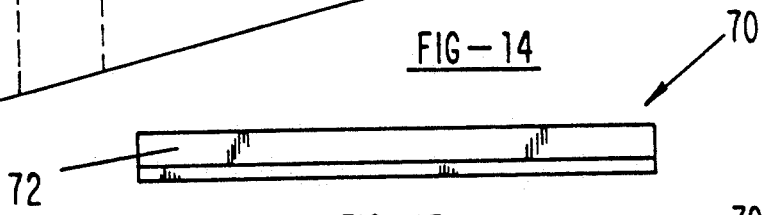
FIG. 15 is a top plan view of an alternative adapter bracket according to the invention.
Figure 16:
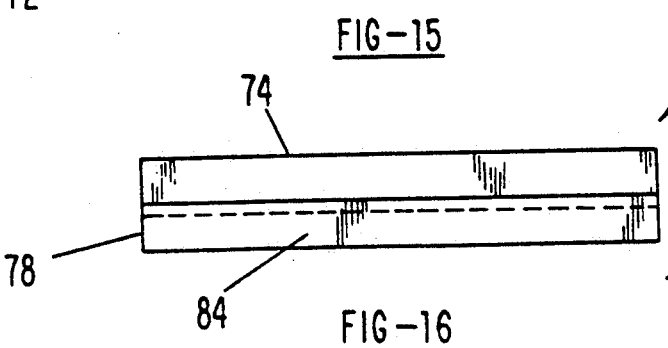
FIG. 16 is a front view of the FIG. 14 embodiment.
Figure 17:
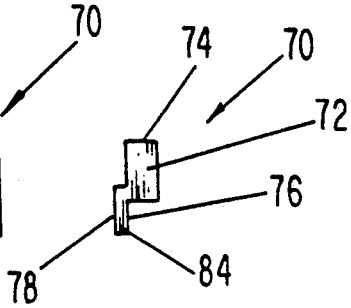
FIG. 17 is a side view of the FIG. 14 embodiment.
Figure 18:
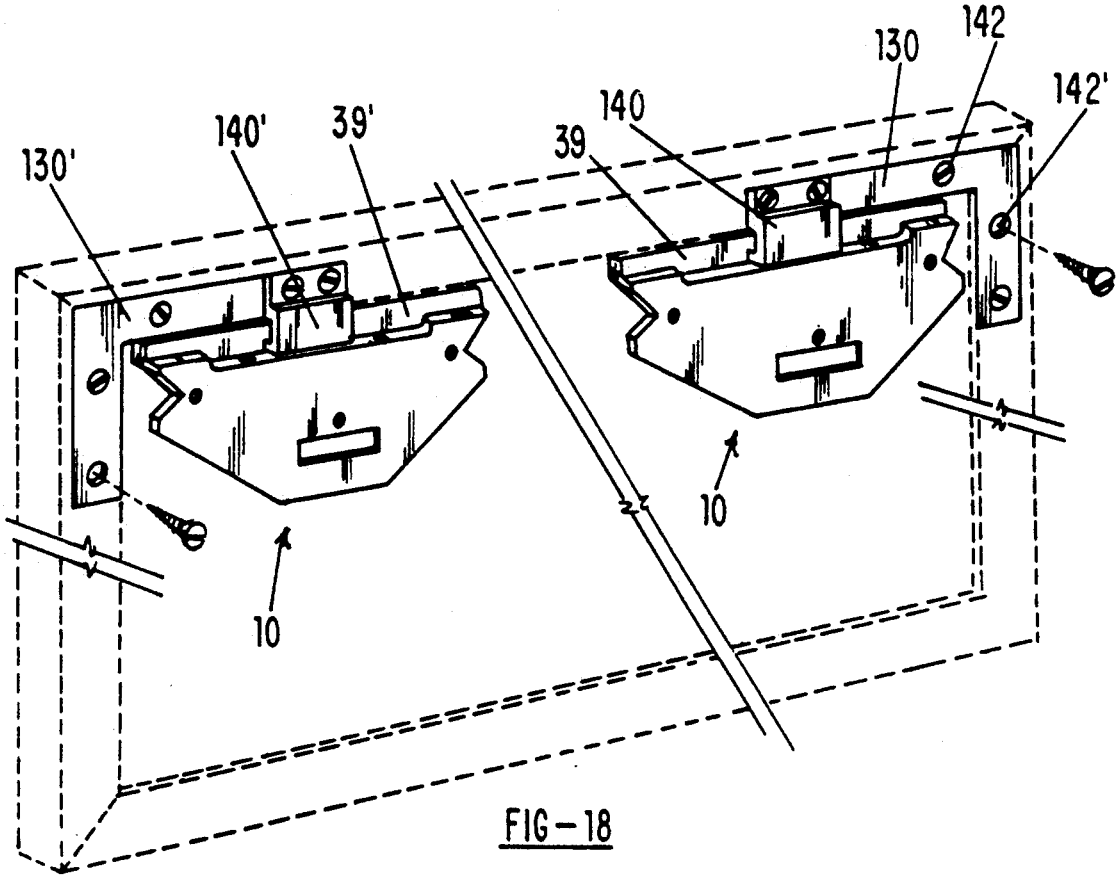
FIG. 18 is a perspective view of an alternative embodiment of the invention for mounting on, e.g., wooden frames.
Figure 19:
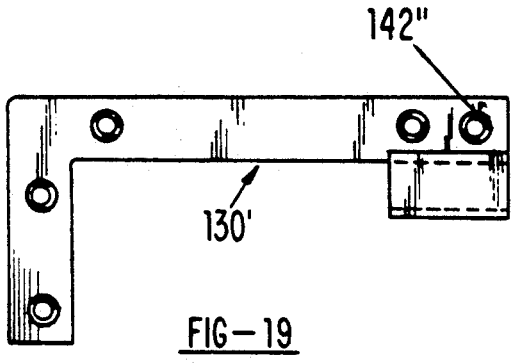
FIG. 19 is a front view of a right-hand corner bracket according to the apparatus of the invention.
Figure 20:
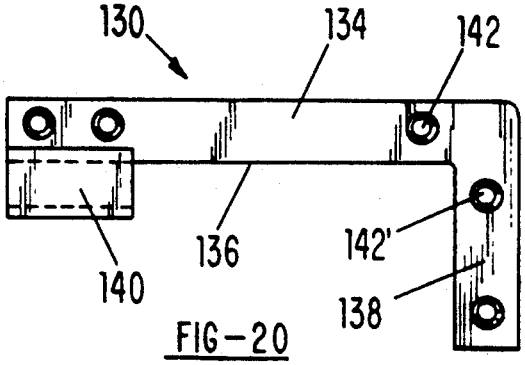
FIG. 20 is a front view of a left-hand corner bracket according to the apparatus of the invention.
Figure 21:
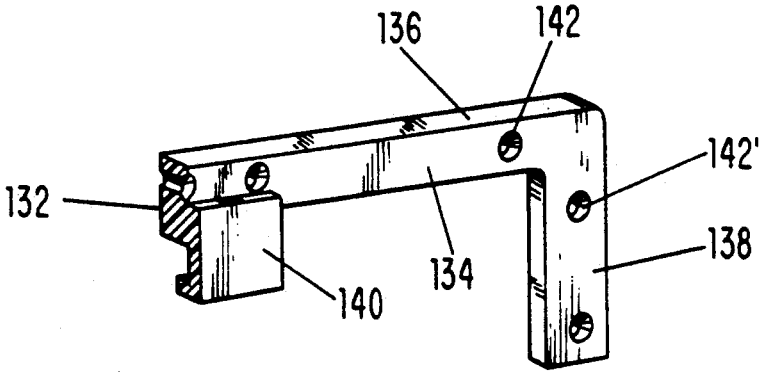
FIG. 21 is a perspective cross-sectional view of the FIG. 20 embodiment.

The use of adapter bracket 70 is straightforward. Referring to FIG. 14, adapter bracket 70 is mounted on the center of the back side (the side to be placed against the wall) of the frame 48. The adapter bracket 70 is mounted by placing reinforcing ridge 72 against the frame 48, with top 74 parallel to the top of frame 48, and with interior face 76 toward the frame 48. Utilizing adapter fastener holes 80,80', adapter bracket 70 is fastened to frame 48 with screws, nails, or the like. Fastener heads are recessed into beveled openings of adapter fastener holes 80,80'. The frame may then be hung upon a wall-mounted body 10 of the invention simply by inserting adapter bracket flange 84 into the bracket recess 39 between body 10 and the mounting surface.

In the alternative, a commonly available Z-bracket (disclosed and shown in FIG. 8 of the '061 application, and herein incorporated by reference) in place of adapter bracket 70 permits the invention to be applied to wooden frames, or other frames otherwise lacking universal assembly channels. The Z-bracket is securely attached to the center of the back of the top section of the frame. Using screws, brads or adhesives, one leg of the Z-bracket is horizontally affixed to the top section of the frame, aligned with the top thereof, while the other free leg protrudes outward and downward away from the frame.

When practiced with frames lacking universal assembly channels, the apparatus 10 is attached to the wall using either of the processes described above, i.e. level attachment using spirit level 24 or horizontal wall line 50. When attached flush against the wall, the apparatus 10 will nevertheless comprise a void or pocket between top 12 of body 10 and the wall, as a result of the presence of bracket recess 39.

With continued reference to FIG. 14, it is seen that alternative frame 48 may be hung upon the apparatus by gently placing the free leg of bracket adapter 70 or the Z-bracket into the void of bracket recess 39, between body 10 and the wall, until the bracket rests upon rear ledge 37. The frame's horizontal position may by further adjusted by sliding the bracket back and forth within bracket recess 39 and upon rear ledge 37.

Reference is now made to FIGS. 18–21, showing a pair of corner brackets 130'130' for use in hanging unusually wide or heavy frames. Corner brackets 130,130' are used in conjunction with a pair of mounted bracket bodies 10 as hereinabove described. Corner brackets 130,130' are identical in all respects–except that, as illustrated, they are reverse images of each other, one being adapted to fit a frame's upper left-hand corner, and the other being adapted to the upper right-hand corner. Description of one corner bracket 130 accordingly serves to describe the pair.

Corner bracket 130 is fashioned of any sturdy material, and may be composed of metal or injection-molded plastic. Corner bracket 130 has a basically rectangular cross section, and is generally L-shaped with a long leg 136 joined at a right angle with short leg 138. Corner bracket 130 has interior face 132 and exterior face 134. Protruding from long leg 136, near its "free" or distal end and in the same direction as short leg 138, is corner bracket flange 140. Corner bracket flange 140 is a mostly planar web or fin, thinner in cross section than corner bracket 130.

Long leg 136 and short leg 138 are each pierced with at least one corner bracket fastener hole 142,142',142''. The openings of the corner bracket fastener holes 142,142',142'' are beveled at their openings to permit recessed fastener heads.

Corner brackets 130,130' are used in conjunction with a pair of bodies 10,10'. Two bodies 10,10' are mounted on the wall, using hereinbefore described procedures, near the desired locations of the frame's corners. Ordinarily, mounted bodies 10,10' should be separated by a horizontal distance somewhat less than the width of the frame to be hung. Corner bracket 130 is mounted upon the frame by placing its interior face 132 against the back of the frame. Utilizing the corner bracket fastener holes 142,142', a corner bracket 130 is fastened to the frame at each of its upper corners with nails, screws, or the like. Long leg 136 is fastened to the top section of the frame, while short leg 138 is fastened to the side section of the frame. The frame may then be hung by inserting the corner bracket flanges 140,140' into the bracket recesses 39,39' between bodies 10,10' and the wall.

The apparatuses, and methods for their use, permit a user to quickly, easily, and consistently hang frames horizontally and flush against a wall. Openings in the body grasp nails or other fasteners and hold them in ready position for hammering or screwing, freeing the user's hands to position the apparatus and securely attach it to the vertical mounting surface.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and of the corresponding application are hereby incorporated by reference.

What is claimed is:

1. An apparatus for hanging a frame on a surface, comprising:

a body having a front, a back, sides and a top;

means for aligning said body on the surface;

an elongated recession with a horizontal bottom, said recession disposed within on said back between said body and the surface;

an adapter bracket, comprising flange means horizontally slidably engageable with said horizontal bottom of said elongated recession, said adapter bracket attachable to the frame; and means for providing attachment of said body to the surface.

2. An apparatus in accordance, with claim 1 wherein said adapter bracket comprises horizontally protruding flange means corresponding closely in dimensions to /said elongated recession.

3. An apparatus in accordance with claim 1 wherein said body alignment means comprises a spirit level.

4. An apparatus in accordance with claim 3 wherein said spirit level is removably attachable to said body.

5. An apparatus in accordance with claim 3 wherein said body further comprises means for holding said spirit level.

6. An apparatus in accordance with claim 5 wherein said spirit level holding means comprises protruding clip retainer-s.

7. An apparatus in accordance with claim 1 wherein said body alignment means comprises at least two horizontally disposed alignment notches.

8. An apparatus in accordance with claim 7 wherein said alignment notches are disposed on said sides of said body.

9. An apparatus in accordance with claim 7 wherein said alignment notches are alignable to a straight line marked on the surface.

10. An apparatus in accordance with claim 7 wherein said alignment notches comprise V-shaped depressions on said sides of said body.

11. An apparatus in accordance with claim 1 wherein said means for providing attachment of said body to the surface comprises ar least two openings completely penetrating said body from said front to said back for firmly holding fasteners.

12. An apparatus in accordance with claim 11 wherein said openings comprise tapered predetermined diameters corresponding to diameters of said fasteners.

13. An apparatus in accordance with claim 11 wherein at least one of said openings is located near the center of said body.

14. An apparatus in accordance with claim 11 wherein at least one of said openings penetrates said body at an oblique angle.

15. An apparatus in accordance with claim 1 further comprising means for securing at least one corner of the frame onto at least one said body.

16. An apparatus for hanging a frame on a surface, comprising:

a body having a front, a back, sides and a top;

means for aligning said body on the surface;

an elongated recession with a horizontal bottom, said recession disposed on said back;

an adapter bracket engageable with said horizontal bottom of said elongated recession, said adapter bracket attachable to the frame;

means for providing attachment of said body to the surface; and means for securing at least one corner of the frame onto at least one said body, wherein said securing means comprises a right-angle corner bracket having protruding flange means corresponding to said recession in said body.

17. An apparatus for hanging a frame on a surface, comprising a removably insertable bottom retaining pin for attaching the bottom of the frame to the surface, wherein said retaining pin comprises box-shaped pin head corresponding to a universal assembly channel in the frame.

18. An apparatus in accordance with claim 17 further comprising corresponding socket means.

19. An apparatus in accordance with claim 17 wherein said socket means comprises an opening corresponding in shape to said bottom retaining pin.

20. An apparatus in accordance with claim 17 wherein said socket opening and said retaining pin are box-shaped.

21. A method for hanging a frame having a universal assembly channel, the method comprising the steps of:

a) removably placing a head of a bottom retainer pin into the universal assembly channel on the bottom of the frame; and b) inserting the bottom retaining pin into the mounting surface.

22. The method of claim 21 wherein the step of removably placing the head of the bottom retainer pin comprises the step of rotating the head within the universal assembly channel to interlock the head within the universal assembly channel.

23. The method of claim 22 wherein the step of inserting the retaining pin comprises the step of drilling an opening in the mounting surface.

24. The method of claim 23 wherein the step of inserting the bottom retaining pin comprises the additional step of disposing a female socket within the opening.

25. The method of claim 24 wherein the step of inserting the bottom retaining pin comprises the additional step of pushing the bottom retaining pin into the female socket.

* * * * *